US005247765A

United States Patent [19]

Quintana

[11] Patent Number: 5,247,765

[45] Date of Patent: Sep. 28, 1993

[54] ABRASIVE PRODUCT COMPRISING A PLURALITY OF DISCRETE COMPOSITE ABRASIVE PELLETS IN A RESILIENT RESIN MATRIX

[75] Inventor: Jesus B. Quintana, Barcelona, Spain

[73] Assignee: Abrasive Technology Europe, S.A., Spain

[21] Appl. No.: 734,629

[22] Filed: Jul. 23, 1991

[51] Int. Cl.[5] ..... B24D 7/06

[52] U.S. Cl. ..... 51/209 R; 51/309; 51/298; 51/295

[58] Field of Search ..... 51/298, 295, 209 R, 51/308, 307, 309

[56] References Cited

U.S. PATENT DOCUMENTS

| | | | |
|---|---|---|---|
| 3,955,324 | 5/1976 | Lindstrom | 51/309 |
| 4,373,934 | 2/1983 | Hayden | 51/309 |
| 4,591,364 | 5/1986 | Phaal | 51/309 |

*Primary Examiner*—Bruce M. Kisliuk
*Assistant Examiner*—Eileen P. Morgan
*Attorney, Agent, or Firm*—Francis T. Kremblas, Jr.

[57] ABSTRACT

An abrasive product comprising a plurality of discrete composite abrasive pellets is formed of particulate abrasive within a rigid material retained in a resilient resin matrix. The abrasive pellets may be formed by conventional metal bonding processes or pressed and sintered in a ceramic or glass matrix. The resilient resin matrix may be in disc or other forms including raised segments connected by a web and supported by a flexible backing material useful for rough finishing of stone, glass; or other hard materials. Particularly useful is a composite product incorporating particulate abrasive material distributed through the resin matrix with spaced abrasive pellets embedded in a spaced, selected pattern over the face of the resin matrix to provide a composite of abrasive pellets and particulate abrasives in a resin matrix.

19 Claims, 3 Drawing Sheets

ABRASIVE PRODUCT COMPRISING A PLURALITY OF DISCRETE COMPOSITE ABRASIVE PELLETS IN A RESILIENT RESIN MATRIX

TECHNICAL FIELD

This invention relates to abrasive products and more particularly to abrasive products incorporating a plurality of composite abrasive pellets in a resin matrix.

BACKGROUND ART

U.S. Pat. No. 4,826,508 describes a method of making abrasive products, which comprises diamond-embedded nickel nodules electrodeposited onto a conductively rendered backing fabric. Such products, which are conveniently used in the form of belts or discs for rough finishing of stone, marble and other tough materials, can only be used for the initial abrading operation. In order to produce a fine, polished finish, use must be made of resin-bonded abrasive products, for example as described in published PCT application no. PCT/GB89/01059. Such abrasive products have a pattern of molded resin segments including diamond particles formed on a substrate. The resin, which is applied in the form of a liquid or paste during manufacture, bears fine diamond particles and can be used to produce a highly polished finish, such as is observed in facing panels used on the walls and floors of buildings. Such resin bonded products have too short a useful life to be practical for initial rough finishing purposes.

Therefore it has been necessary to employ the electroplated single layer product or alternatively a conventionally molded, multi-layer, metal bonded product for rough finishing prior to using the wholly resin-bonded product for the final polishing operation.

However, the electroplated product and particularly the molded metal-bonded rigid abrasive products of the prior art tend to leave scratches during the initial roughing work having a depth requiring further abrading steps prior to performing the subsequent final polishing stage. While the initial abrasive product should aggressively and efficiently abrade the work surface, the tendency to leave scratches or pits of significant depth is a troublesome and undesirable problem, heretofore not satisfactorily solved by prior art methods and means.

An object of the present invention is to alleviate the aforementioned disadvantage.

SUMMARY OF THE INVENTION

The present invention relates generally to abrasive grinding products and particularly to a novel product incorporating a plurality of discrete composite abrasive pellets retained by means of a solidified resilient resin matrix, said composite abrasive pellets comprising particulate abrasive bound together by a rigid matrix of hard material. As well-known to those skilled in the art composite metal, ceramic or vitrified abrasive tools in various shapes including pellets are formed by a molding and pressing procedure, sometimes using heat, to bind the abrasive particles throughout the depth of the hard rigid material forming the matrix. Such abrasive products are referred to as multi-layer abrasive tools wherein the new abrasive particles are exposed to do work as the hard matrix is worn away during use.

The hard matrix material is preferably metal, such as nickel or bronze, or various suitable alloys well known in the art, although other suitable materials, such as ceramics or glass may be employed. For stone floor and wall panels, the pellets may typically be in the $\frac{1}{4}$ to $\frac{3}{4}$ inch diameter range, however, the size may be varied to fit the requirements of the particular application.

In prior art products, a resin matrix has not satisfactorily supported diamond crystals of appropriate size that must be subjected to extreme stress and/or pressures of the rough finishing work necessary prior to final polishing of stone, ceramics or glass, for example, to provide economically practical, useful life spans of the product. It has been found, surprisingly, that by incorporating the composite pellets in the resilient resin matrix, a resin-type abrasive product can be made that is capable of carrying out rough finishing operations. The resilient resin matrix supports the abrasive pellets in a manner that tends to eliminate the formation of deep scratches in the work surface, yet the metal-bonded pellets are capable of performing the heavy-duty gross removal work necessary prior to finishing or polishing in a surprisingly efficient and effective manner.

Products can be made that have significantly greater grinding ratios (material removed versus abrasive wear) than for resin bonded tools carrying particulate abrasive alone. Also, products competitive with conventional metal bonded products can be made at substantially lower prices. A further advantage is obtained by products constructed in accordance with the present invention by allowing more flexible design of the product relative to more efficient working of materials having varying characteristics, such as the varying surface hardness of different grades of stone.

The products can be formed into discs, for example, with a conventional snaillock attachment to a power tool, or pads and segments of other shapes, preferably with a VELCRO backing. Two such segments are known in the trade as the Frankfurt segment, which is of roughly rectangular shape, and the Munich segment, which is of roughly trapezoidal shape are presently used in wholly resin bonded polishing pads.

The invention also provides a method of making an abrasive product comprising providing a plurality of composite abrasive pellets comprising particulate abrasive bound together by a rigid matrix of hard materials, and bonding said abrasive pellets and a substrate with a resin such that the abrasive pellets become embedded in the surface of the solidified flexible resin matrix.

Preferably, the abrasive pellets are in the form of truncated cones bearing diamond grit or other superabrasive materials, such as cubic boron nitride. A conical or frusto-conical configuration allows for improved retention when the pellet rests on its base while surrounded and held in place by the resin matrix. It also has the advantage of being self-sharpening. The reduced area at the initial point of contact of the pellet with the workpiece increases erosion of the metal matrix surrounding the diamond grit, thus exposing the diamond grit faster and substantially eliminating the break-in time normally associated with metal-bonded tools. Even greater retention can be achieved by molding a rim at the coné base or attachment of the pellet to, for example, a wire mesh. Plain cylindrical shapes can also be employed, but are better suited to lighter removal operations. The grit size is preferably quite coarse, for example, 30/40 and 40/50, although it may 100/200 mesh or smaller as may be required or best suited to a given application.

The invention will now be described in more detail, by way of example only, with references to the accompanying drawings, in which:

Figure 1A:
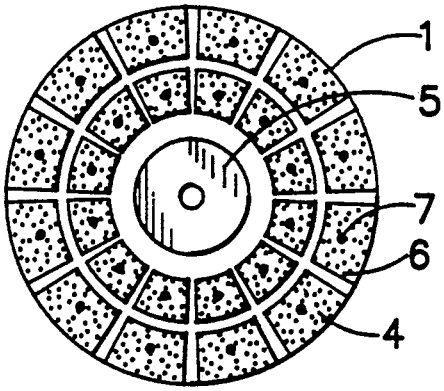
FIG. 1*a* is a plan view of an abrasive disc with metal-bonded pellets constructed in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

Figure 1B:
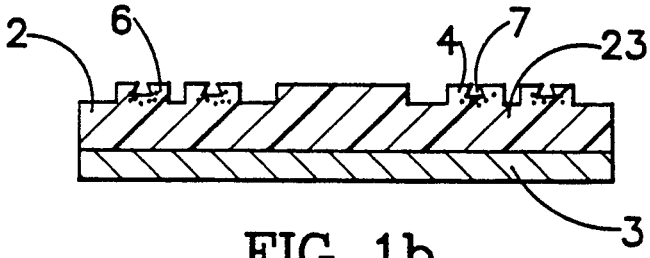
FIG. 1*b* is a diagrammatic cross-section of the disc shown in FIGS. 1*a;*

Referring now to FIGS. 1*a* and 1*b*, the abrasive disc 1 comprises a solidified epoxy resilient resin matrix 2 formed on a flexible backing sheet 3. The backing sheet or substrate 3, for example, may consist of a woven fabric which provides desirable strength yet is sufficiently flexible so as not to interfere with the desired resiliency of the final structure of the matrix 2. Materials such as KEVLAR, commercially available from Du-Pont Corporation, or similar materials, such as various polyesters, canvas etc may be usefully employed depending upon the given application. As seen in FIG. 1, the resin matrix 2 forms a predetermined pattern of raised segments 4. The disc has a central region 5 for attachment to a power tool in a conventional manner, such as by means of a snaillock.

In the embodiment shown, the resin matrix 2 has diamond particles 6 having a mesh size of 100/120 distributed in the raised segments 4. However, the diamond particles 6 can be of a wide range of sizes or may be omitted as may be desirable for any particular application. Of course, if omitted, the manufacturing costs are substantially reduced.

Embedded in the raised segments 4 are composite abrasive pellets 7. These consist of sintered bronze pellets into which a complementary size diamond grit has been incorporated prior to the sintering operation. In certain applications, only certain of the raised segments may contain one or more embedded pellets 7 to modify or adjust the abrading action relative to the material intended to be worked upon. The remainder of the segments 4 may contain particulate abrasive particles 6 which cooperate with those segments containing pellets 7 to provide a composite product which has been shown in tests to provide a superior initial finish to the work surface compared to comparable prior art products and a very useful and practical life span at an economical cost.

Figure 2:
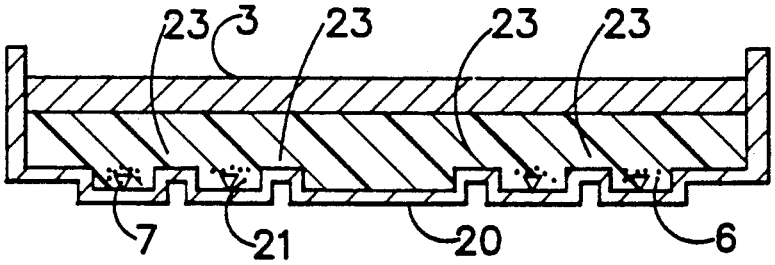
FIG. 2 is a cross-section through a mold for forming an abrasive product such as shown in FIG. 1.

The abrasive product may be manufactured as shown in FIG. 2 with the aid of the mold 20. First, the metal-bonded abrasive pellets 7, manufactured as described above for example, are placed in the depressions 21 formed in the mold 20. It will be understood by those skilled in the art that conventional metal bonded pellets work well within the context of the present invention. Next, an epoxy resin, preferably in a conventional, commercially available two part liquid form, is poured into the mold 20. Diamond particles 6 may be added to the resin as desired, as well as various other fillers and color additives. Subsequently, one or more sheets of flexible backing material 3, such as described earlier herein, is coated with the same resin, laid on the mold, and the resin allowed to cure. On removal from the mold, the resulting product, shown in FIG. 1*a*, has the raised segments 4 bearing the pellets 7 arranged in a predetermined regular pattern on the substrate or backing sheet 3.

In the manufacture of such products in accordance with the present invention, heat or light cured resins may be deemed desirable to form the resin matrix.

Figure 3A:
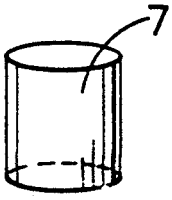
FIG. 3*a* to 3*c* illustrates typical shapes useful for the abrasive pellets forming a portion of the abrasive product shown in FIGS. 1 and 4.
Figure 3B:
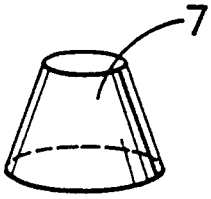
Figure 3C:
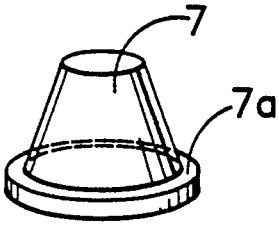

The pellets 7 can have different shapes, such as the examples shown in FIGS. 3*a* to 3*c*. Frusto-conical or cylindrical shapes are preferred for many types of applications a they tend to assist in retention of the pellets in the resin matrix. Further, molding of a rim 7*a* surrounding the base of a cylindrical shaped pellet or a frusto-conical shaped pellet, such as illustrated in FIG. 3*c* tends to improve retention of pellets 7 in the resin matrix. A further example of providing means to better secure pellets 7 in the resin matrix 2 would involve fixing the pellets on a fine wire screen or mesh by welding or other suitable means, not shown, in a pattern coordinated with their position in the depressions formed in mold 20. The screen of mesh should be chosen so as not to detrimentally effect the desired degree of resiliency of the resin matrix surrounding and retaining the pellets in the raised segments 4 for a given application.

However, it should be understood that various other shapes of pellets 7 can be usefully employed without departing from the present invention, including irregular shapes.

The resin is preferably an epoxy resin. With epoxy resins, manufacturing costs are considerably lower and high material removal rates can be achieved with a lower concentration of superabrasive particles. It should be readily appreciated by those skilled in the art that a great many types of commercially available epoxy resins or equivalent materials possessing the necessary strength and degree of desired resiliency may be employed to form matrix 2 to obtain beneficial results according to the teachings of the present invention.

The useful life of the abrasive tool having the composite abrasive pellets embedded in a resilient resin matrix is dependent upon the typical expected life of the abrasive pellets as long as they are operably retained by the resin matrix. Conventional additives may be incorporated into the resin matrix to improve its wear-resistance and heat dissipating capabilities. The use of diamond or other superabrasive particles dispersed throughout the resin matrix tends to improve the wear resistance of the resin matrix, and in appropriate configurations contributes to the abrading action of the tool.

Figure 4A:
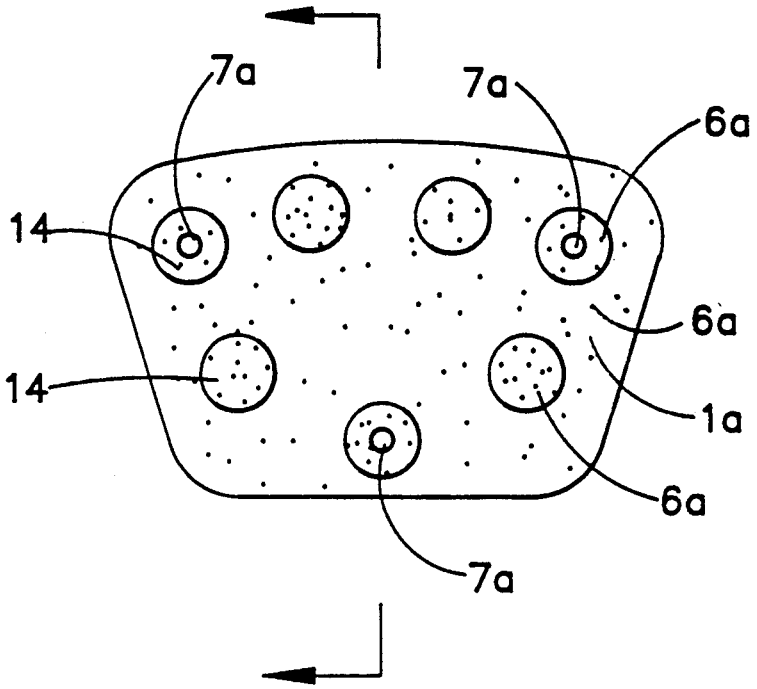
FIG. 4*a* is a plan view of a modified form of an abrasive pad constructed in accordance with the present invention.
Figure 4B:
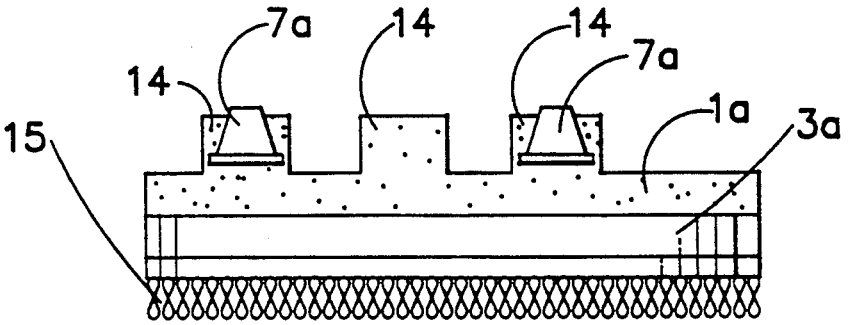
FIG. 4*b* is a diagrammatical side elevational view of the modified embodiment shown n FIGS. 4*a;*

An additional advantage of the present invention is that the number and pattern of segments 4 including a pellet 7 can be varied relative to the total number of segments 4 formed such as shown in the embodiment seen in FIG. 4*a* and 4*b*. In this embodiment, the resin matrix includes abrasive particles 6 and certain segments 4 contain embedded abrasive pellets 7. By selecting and spacing the number of segments 4 containing pellets 7 relative to those having only dispersed abrasive particles, another parameter, in addition to abrasive particle size and concentration, is provided to control the grinding process and the characteristics of the surface finish obtained. This is particularly useful, for example, in designing an abrasive product for rough finishing different grades of marble which have different surface hardness characteristics.

The abrasive pad shown in FIGS. 4*a* and 4*b* has the well-known "Munich" style trapezoidal shape and comprises a generally trapezoidal resin matrix base 1*a* and a flexible substrate 3*a* of the same nature as the flexible backing fabric 3 described herein regarding the embodiment of FIG. 1. A conventional VELCRO or equivalent fastening attachment 15 is fixed to the backing fabric or substrate 3*a* and is adapted to be attached to a complimentary tool face in a well-known manner.

In accordance with the present invention, the number of raised generally cylindrical segments 14 containing pellets 7*a* can be varied alone or in combination with the segments 4 containing abrasive particles 6 to more efficiently adjust removal rates and the surface finish characteristics compared to prior art products consisting solely of rigidly held metal bonded abrasives or the nickel-bonded nodules referred to earlier herein.

Employing a combination of the abrasive pellets embedded within the resilient matrix as described herein with raised segments having particulate abrasives dispersed therein offers economy of manufacture with significant beneficial results more easily adapted to the various applications in the field.

Tests have shown that products constructed in accordance with the present invention very efficiently provide a superior surface finish yet are not so aggressive as conventional metal bonded tools and eliminate or dramatically reduce the occurrence of the detrimental surface scratches on the work surface as mentioned earlier herein. Further, they are substantially longer lasting than solely resin bonded products, and provide a highly competitive and desirable alternative to prior art products such as presently used in the rough finishing work on stone panels. The deep scratches left by prior art metal bonded tools during rough finishing require additional finishing steps and significantly more time and effort to remove the same prior to the desired final polishing step using conventional resin bonded pads.

With the product made according to the invention, the material removal rates can be considerably higher than conventional products because of the ease of varying the pattern and spacing of the pellet containing segments. Also, tests have shown that using products made according to the present invention, particularly with certain stones, leave the surface in a polishable state without pitting that might result in an "orange peel" effect or deep scratches which must be worked out to properly ready the surface for the final polishing step.

The described abrasive product can be made in forms other than discs, as seen in FIG. 1, such as disc segments for example. It can conveniently be made in the form of 75 or 100 mm. discs with VELCRO attachment means on the backing and any of the following grit sizes: 50/60; 100/120; 120, 220, 400, 800, 1800, 3000. These discs can be used with standard electric or pneumatic power tools.

While a flexible substrate 3 such as described herein is preferred, it should be noted that for some applications, the resin matrix may be formed such that the web of solidified resin matrix 2 between the raised segments 4 may serve the intended support purpose adequately without a substrate such as 3. The flexible substrate primarily serves as additional support for a relatively thin connecting web portion 23 between segments 4, particularly if the web portions should be fractured during use by exceptional abuse or other causes.

Figure 5A:
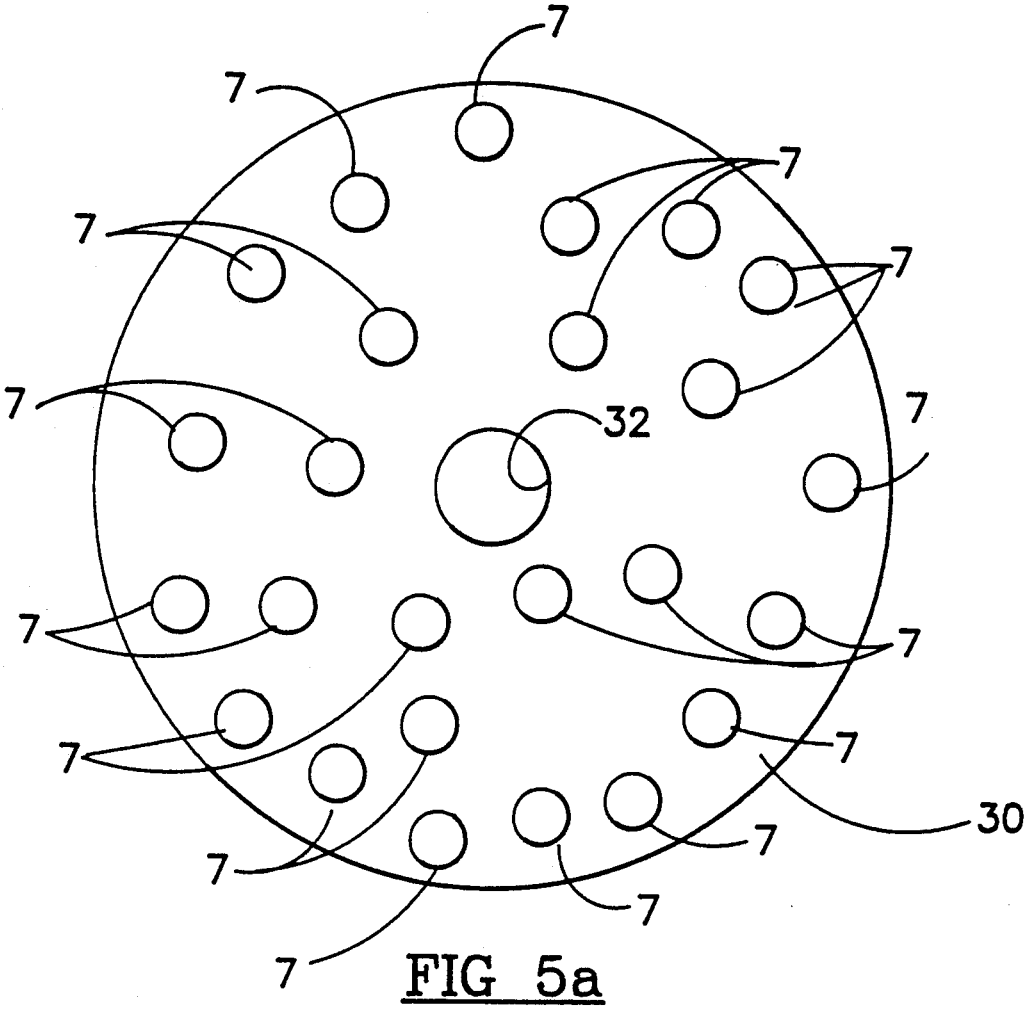
FIG. 5*a* is a diagrammatic plan view of another embodiment of the present invention illustrating a disc constructed in accordance with the present invention.
Figure 5B:
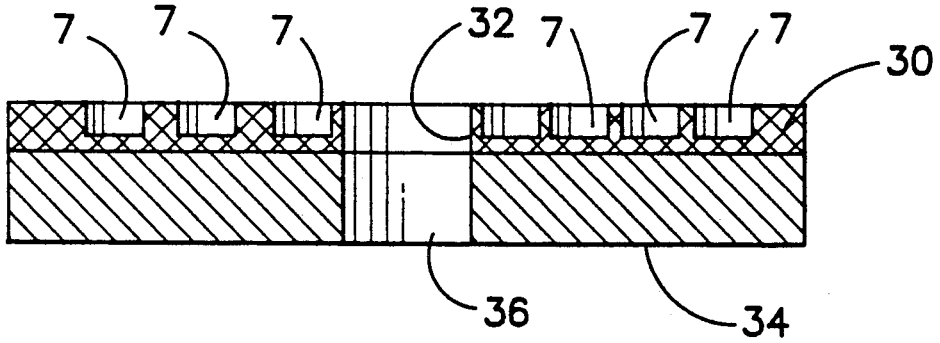
FIG. 5*b* is a diagrammatical side sectional view of the embodiment shown in FIGS. 5*a* illustrating the abrasive pellets embedded in the resin matrix.

In applications wherein raised segments are not desired or necessary for a given grinding application. the pellets 7 may be embedded in a disc, or other useful shape, in a resin matrix having a generally planar work surface. Such a construction is diagrammatically illustrated in FIGS. 5*a* and 5*b*. The abrasive tool comprises a resin matrix in the form of a cylindrical disc 30 in which a plurality of cylindrical abrasive pellets 7 are embedded. Pellets 7 are spaced from one another in a predetermined pattern as may be desirable for a given application.

The disc 30 is shown with a central opening 32 molded therein to permit acceptance of a driven shaft, for example, of a power tool. However other conventional forms of attaching the disc 30 to a driving tool for grinding and the like may be employed.

A cylindrical metal support plate 34 is shown merely as an example of one mounting surface upon which disc 30 may be suitably attached and supported. Plate 34 also includes a central hole 36 aligned with hole 32 for mounting purposes. Depending upon the particular application, abrasive particles may be dispersed throughout disc 32 or may be omitted.

In accordance with the present invention, the resilient resin matrix retains the composite abrasive pellets in such a manner to provide highly desirable and improved results for many applications as compared to the prior art use of conventional rigidly mounted metal bonded tools and a significantly longer useful life span compared to conventional resin bonded abrasive tools.

Further, the ability to combine the abrading action of the metal bonded pellets with resin bonded particulate abrasives in the resilient resin matrix offers a composite abrading action heretofore unavailable with the advantage of modifying and adjusting the abrading action to meet a wide range of application requirements with relative ease.

It should also be noted that mounting the abrasive pellets in a resilient resin matrix in a manner according to the present invention provides a means to modify the aggressive attack of the composite pellets without significantly impairing their ability to achieve significantly high grinding ratios.

While certain preferred embodiments of the present invention have been disclosed in detail, it is to be understood that various modifications may be adopted without departing from the spirit of the invention or scope of the following claims.

I claim:

1. An abrasive product comprising a plurality of discrete composite abrasive pellets retained in a spaced relationship from one another generally along the same horizontal plane in a resin matrix including a predetermined pattern of upraised segments connected to one another by a resilient resin matrix web substantially thinner than the height dimension of said raised segments with at least one of said composite abrasive pellet embedded within certain of said raised segments, each of said composite abrasive pellets comprising particulate abrasive bound together by a rigid matrix of hard material.

2. An abrasive product as claimed in claim 1, wherein said rigid matrix is metal.

3. An abrasive product as claimed in claim 2 wherein the abrasive pellets comprise sintered metal pellets with abrasive particles pressed therein.

4. An abrasive product as claimed in claim 1, wherein the abrasive pellets are frusto-conical in shape.

5. An abrasive product as claimed in claim 4, wherein the abrasive pellets have a rim surrounding their base.

6. An abrasive product as claimed in claim 1 wherein the resin matrix is a solidified two-part epoxy resin.

7. An abrasive product as claimed in claim 1 wherein the resin matrix contains particulate abrasive to complement the particulate abrasive bound in the abrasive pellets.

8. An abrasive product as claimed in claim 1 wherein the particulate abrasive is a superabrasive.

9. An abrasive product as claimed in claim 8, wherein the superabrasive is diamond.

10. A method of making an abrasive product including the steps of:

bonding a plurality of abrasive pellets within a resilient resin matrix by placing at least one of said pellets in selected depressions of a mold having a predetermined pattern of depressions; pouring a resin in a liquid state into said mold; and allowing the resin to solidify to form a resilient resin matrix provided with upraised segments spaced from one another along substantially the same plane and provided with a resilient connecting web of resin between each upraised segment substantially thinner than the height dimension of said upraised segments.

11. A method of making an abrasive product as claimed in claim 10, wherein the composite abrasive pellets are metal-bonded pellets.

12. A method of making an abrasive product as claimed in claim 10, wherein the rigid matrix forming said pellets is made by pressing particulate abrasive with a powder taken from the group consisting of metal, ceramic or glass powders, followed by heating as required to form the abrasive polish.

13. A method of making an abrasive product as claimed in claim 10, wherein the metal-bonded pellets are in the form of truncated cones.

14. A method of making an abrasive product as claimed in claim 10 wherein abrasive particulate material is dispersed in the resin prior to pouring said resin in the mold.

15. A method of making an abrasive product as claimed in claim 10 wherein abrasive particulate material is dispersed in the resin prior to pouring said resin in the molds, and wherein said selected ones of said raised segments contain at least one abrasive pellet and the remaining raised segments contain only particulate abrasive.

16. An abrasive product comprising, in combination:

a) a flexible planar substrate;

b) a resin matrix including a plurality of resin segments upraised from a base forming a resilient resin web substantially thinner than the height dimension of said upraised segments connecting said segments to one another, said base being fixed to said flexible planar substrate;

c) at least one composite abrasive pellet disposed within at least certain of said upraised resin segments to form abrading elements extending generally along a plane generally parallel to said planar substrate and defining the upper portion of an abrading surface of said product, said composite abrasive pellets comprising particulate abrasive bound together by a rigid matrix of material harder than said resin matrix.

17. The abrasive product defined in claim 16 wherein certain of said upraised segments include particulate abrasive dispersed throughout said upraised segments and certain other of said segments contain at least one of said composite abrasive pellets.

18. The abrasive product defined in claim 16 wherein only one composite abrasive pellet is embedded in a respective one of at least a plurality of said upraised segments and has its longest dimension between about one-quarter to three-quarters of an inch.

19. The abrasive product defined in claim 16 wherein said composite abrasive pellets have a generally planar top and bottom surface and wherein said surfaces are disposed generally parallel to the plane of said planar substrate.

* * * * *